US011524510B2

(12) United States Patent
Lee et al.

(10) Patent No.: US 11,524,510 B2
(45) Date of Patent: Dec. 13, 2022

(54) ADJUSTING A PICKUP TIME OF A PRINTING MEDIUM WHEN A TRANSFER DELAY OCCURS OR IS ANTICIPATED TO OCCUR

(71) Applicant: HEWLETT-PACKARD DEVELOPMENT COMPANY, L.P., Spring, TX (US)

(72) Inventors: Ui Choon Lee, Suwon-Si (KR); Chun Sub Ryu, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/962,773

(22) PCT Filed: Jul. 9, 2018

(86) PCT No.: PCT/KR2018/007738
§ 371 (c)(1),
(2) Date: Jul. 16, 2020

(87) PCT Pub. No.: WO2019/142983
PCT Pub. Date: Jul. 25, 2019

(65) Prior Publication Data

US 2020/0356041 A1 Nov. 12, 2020

(30) Foreign Application Priority Data

Jan. 22, 2018 (KR) ..... 10-2018-0007854

(51) Int. Cl.
*B41J 11/00* (2006.01)
*G03G 15/23* (2006.01)
(Continued)

(52) U.S. Cl.
CPC ..... *B41J 11/0095* (2013.01); *B41J 13/0018* (2013.01); *G03G 15/235* (2013.01);
(Continued)

(58) Field of Classification Search
CPC ..... G03G 15/50; G03G 15/55; G03G 15/6564
See application file for complete search history.

(56) References Cited

U.S. PATENT DOCUMENTS

2006/0251456 A1* 11/2006 Kang ..... B41J 11/008 400/76
2006/0268093 A1 11/2006 Kobayashi et al.
(Continued)

FOREIGN PATENT DOCUMENTS

EP 1113974 B1 12/2005
EP 2551725 B1 4/2020
(Continued)

*Primary Examiner* — Jessica L Eley
(74) *Attorney, Agent, or Firm* — Staas & Halsey LLP

(57) ABSTRACT

An image forming apparatus includes an engine to form an image on an image forming medium, a paper transfer device to pick up a printing paper and transfer the paper to a transfer path, a sensor to sense a printing paper at a predetermined position on the transfer path, and a processor to determine whether a transfer delay occurs, when the printing paper is sensed, and adjust a pickup timing to advance a pickup of a printing paper of a next page.

20 Claims, 6 Drawing Sheets

(51) Int. Cl.
*G03G 15/00* (2006.01)
*B41J 13/00* (2006.01)

(52) U.S. Cl.
CPC ..... *G03G 15/6511* (2013.01); *G03G 15/6564* (2013.01); *G03G 15/6567* (2013.01)

(56) References Cited

U.S. PATENT DOCUMENTS

| | | | | |
|---|---|---|---|---|
| 2007/0036575 | A1* | 2/2007 | Hamano | G03G 15/50 399/82 |
| 2008/0260444 | A1 | 10/2008 | Ikeda | |
| 2009/0080910 | A1* | 3/2009 | Kim | G03G 15/70 399/21 |
| 2009/0201525 | A1* | 8/2009 | Nakazawa | H04N 1/0005 358/1.13 |
| 2009/0225363 | A1* | 9/2009 | Endo | G03G 15/80 358/1.15 |
| 2009/0255971 | A1 | 10/2009 | Nakamaki et al. | |
| 2010/0225046 | A1 | 9/2010 | Seto et al. | |
| 2013/0195531 | A1 | 8/2013 | Nakamura | |

FOREIGN PATENT DOCUMENTS

| | | | |
|---|---|---|---|
| JP | 2016-69148 | A | 5/2016 |
| KR | 1020040024016 | | 3/2004 |

* cited by examiner

[Fig. 1]
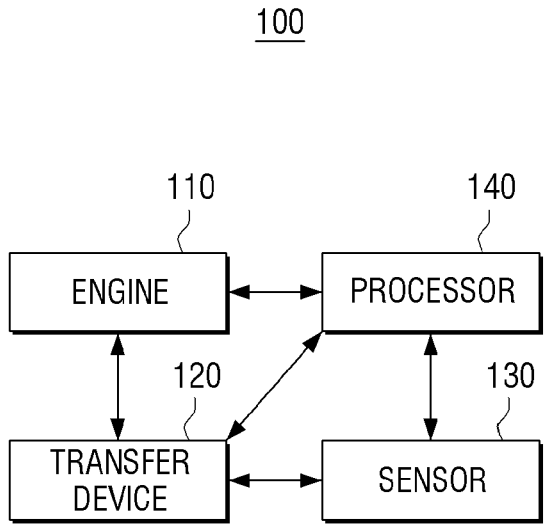
[Fig. 2]
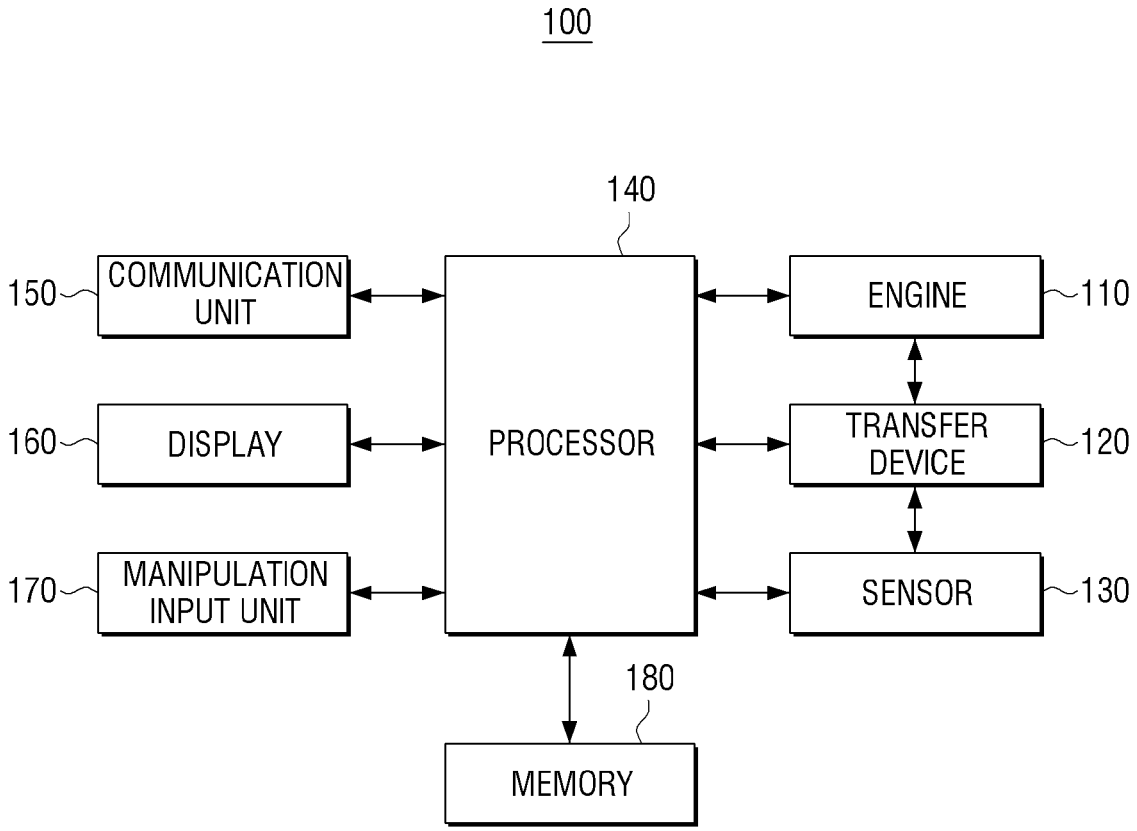

[Fig. 3]
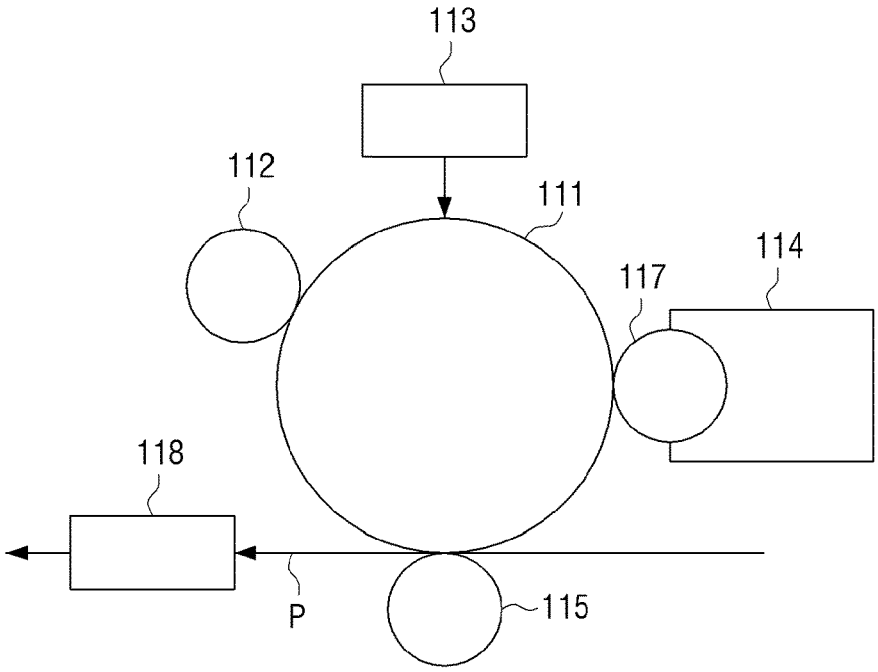
[Fig. 4]
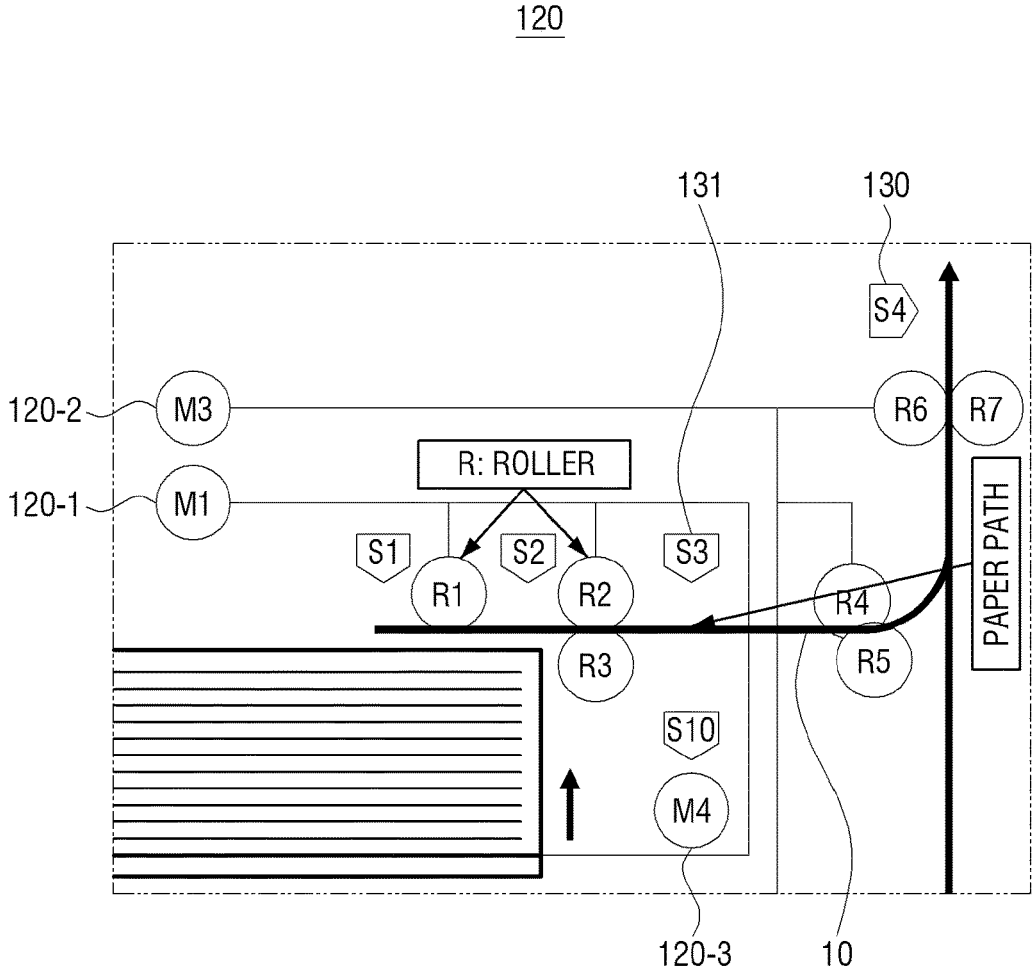

[Fig. 5]
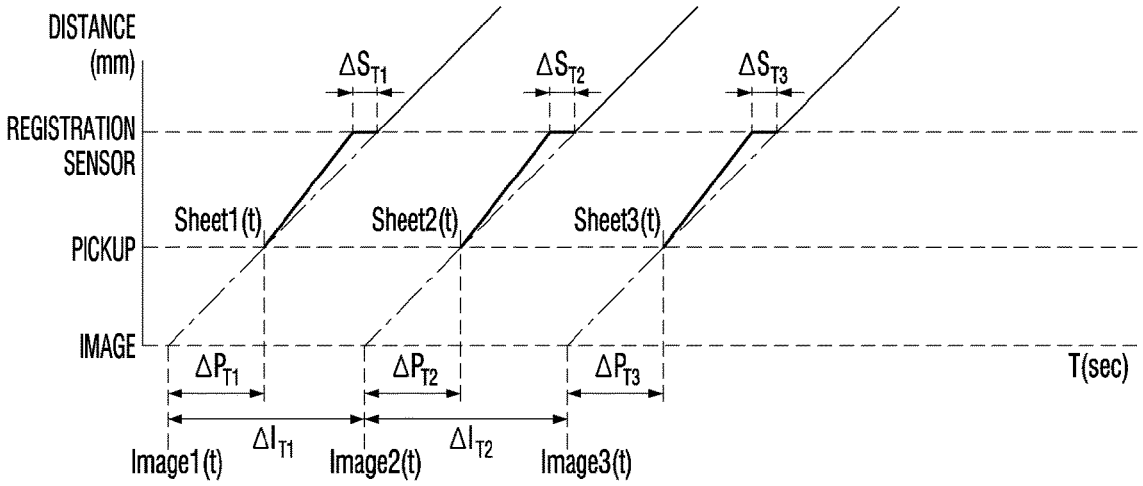
[Fig. 6]
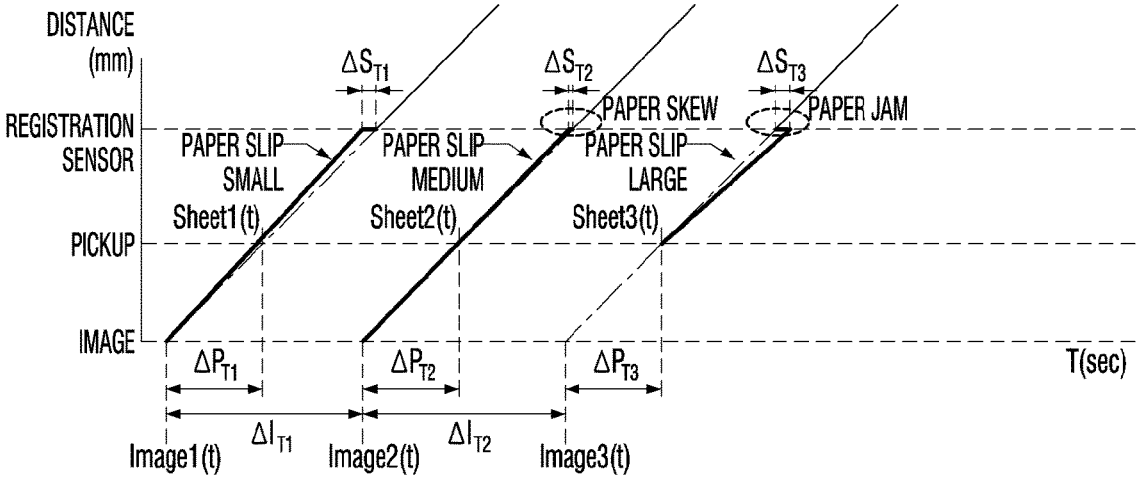
[Fig. 7]
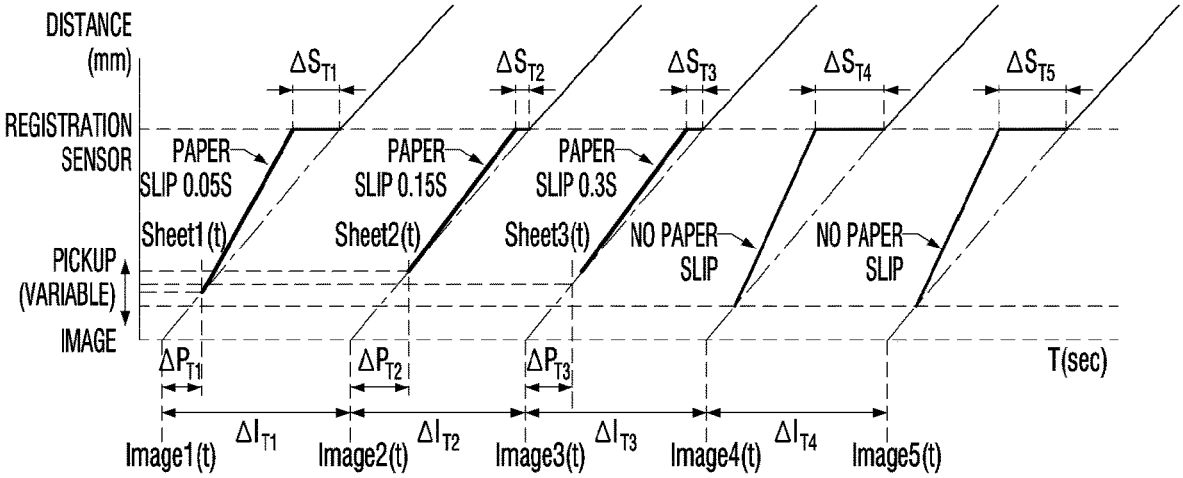

[Fig. 8]
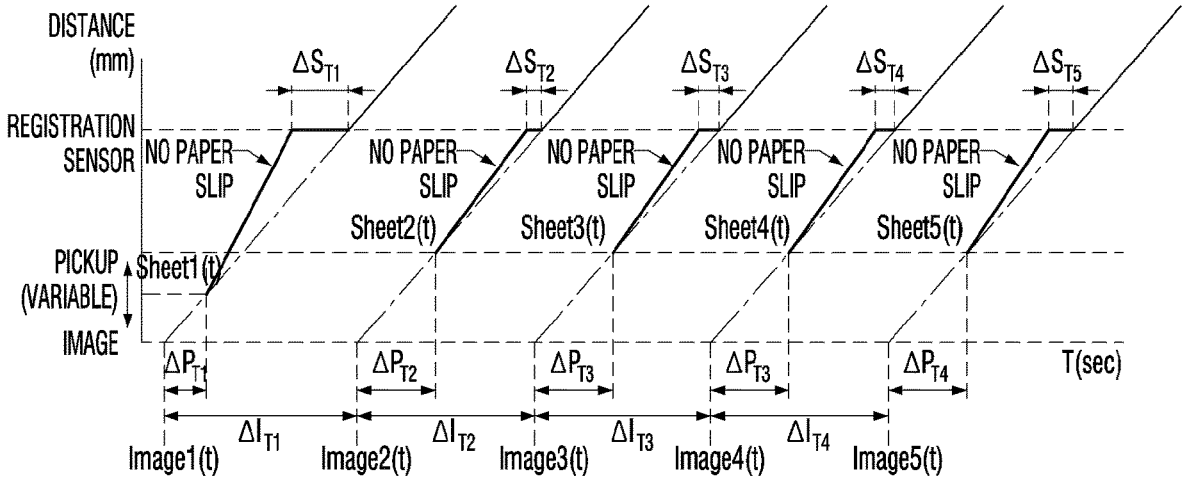
[Fig. 9]
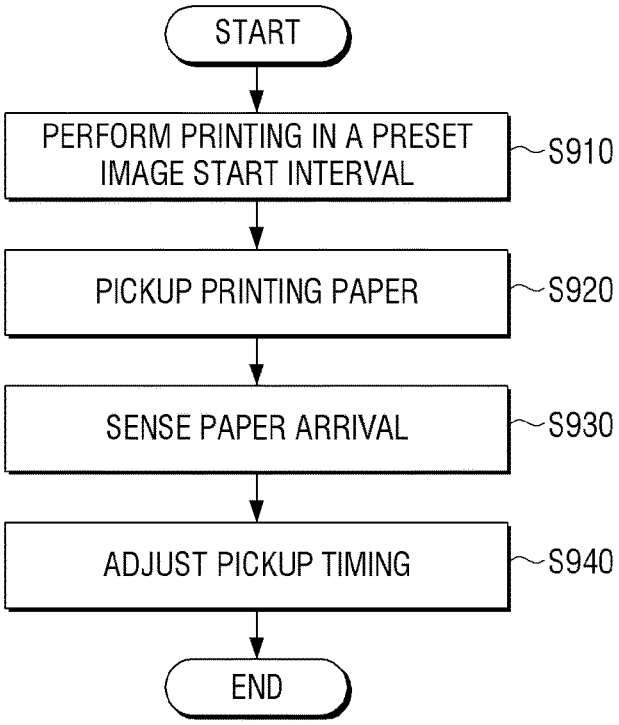

[Fig. 10]
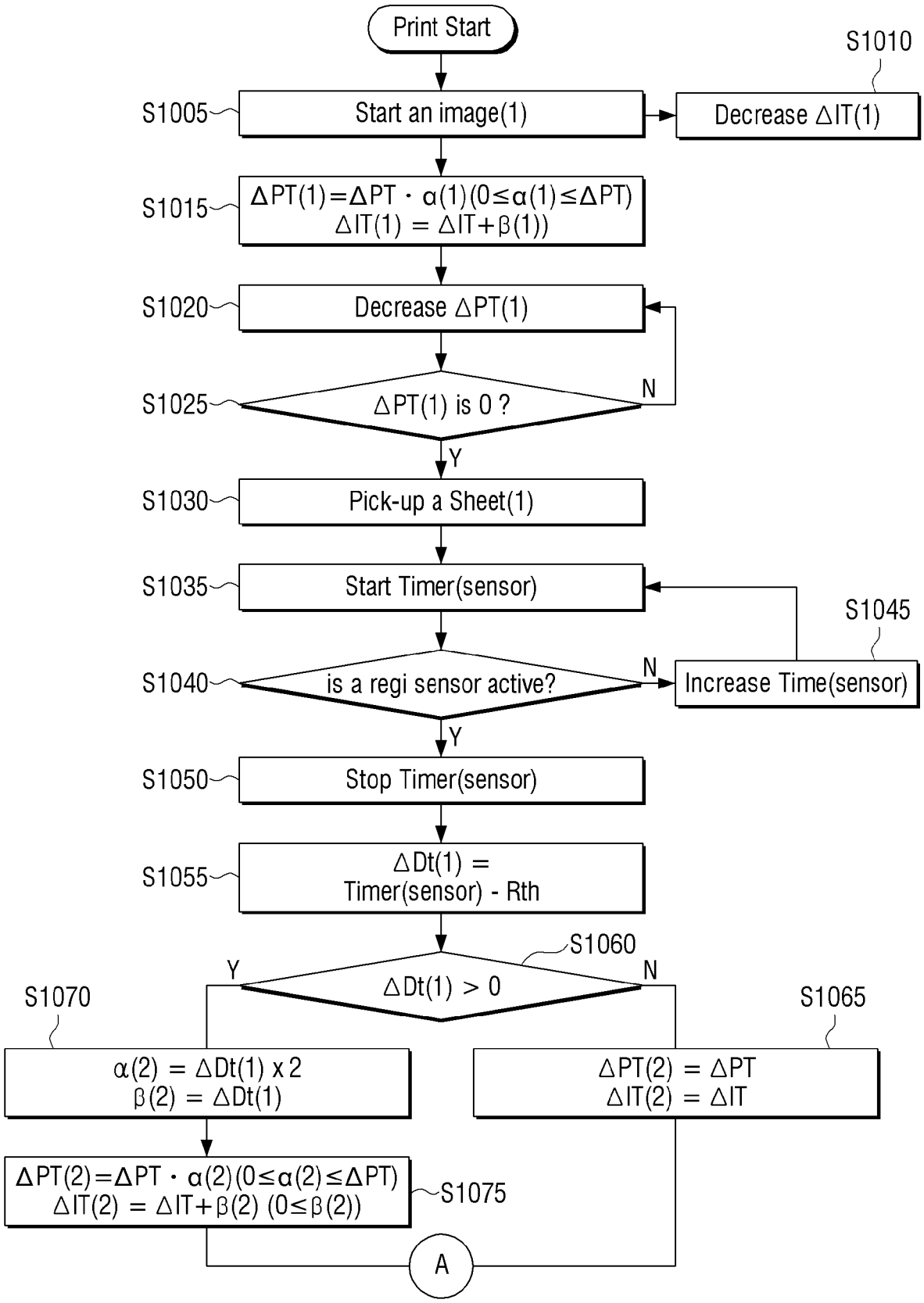

[Fig. 11]
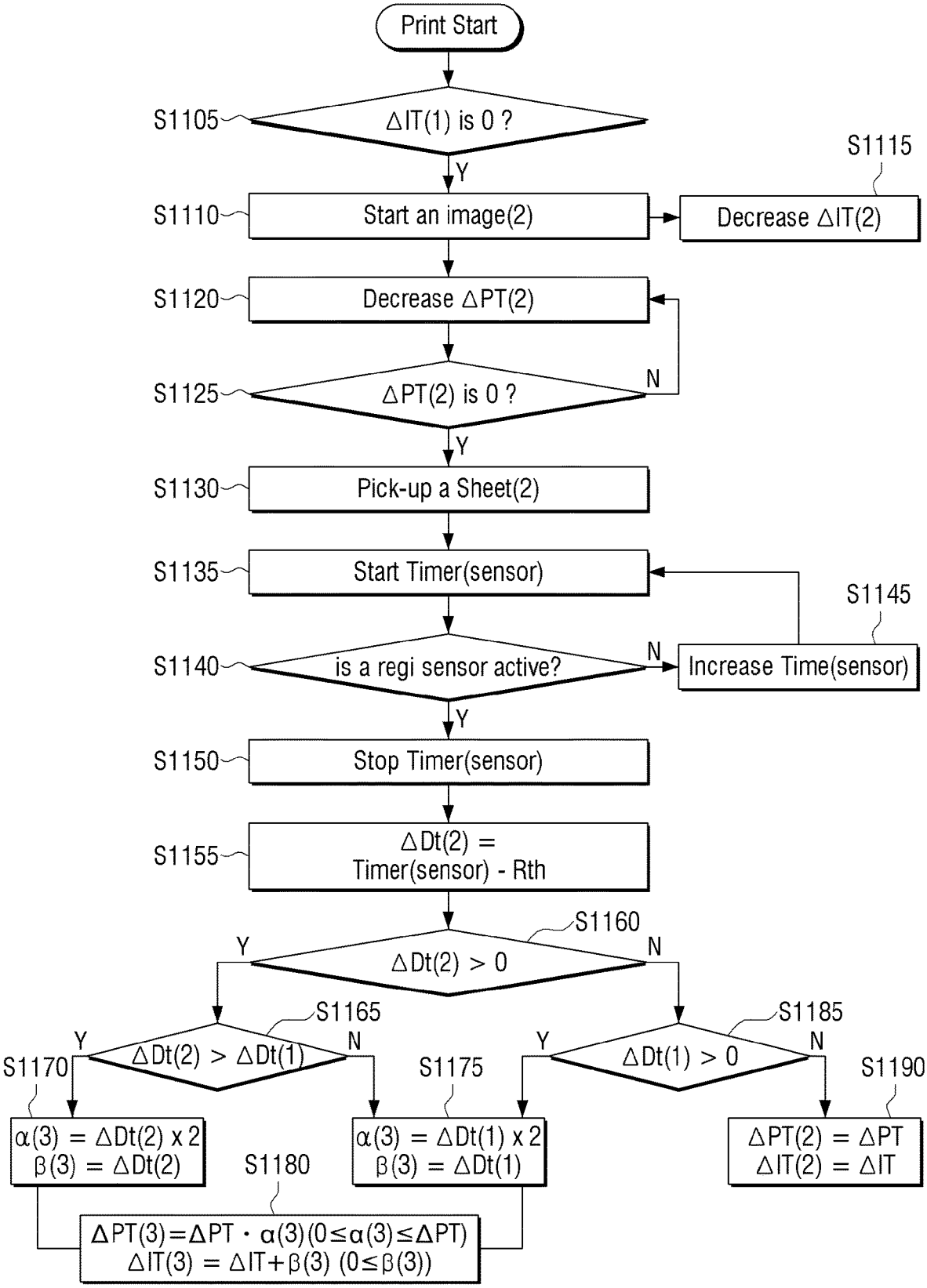

ADJUSTING A PICKUP TIME OF A PRINTING MEDIUM WHEN A TRANSFER DELAY OCCURS OR IS ANTICIPATED TO OCCUR

CROSS REFERENCE TO RELATED APPLICATIONS

This application is filed under 35 U.S.C. 0.371 as a National Stage of PCT International Application No. PCT/KR2018/007738, filed on Jul. 9, 2018, in the Korean Intellectual Property Office, which claims the priority benefit of Korean Patent Application No. 10-2018-0007854, filed on Jan. 22, 2018, in the Korean Intellectual Property Office. The disclosure of PCT International Application No. PCT/KR2018/0007738, filed on Jul. 9, 2018, is incorporated by reference herein in its entirety. The disclosure of Korean Patent Application No. 10-2018-0007854, filed on Jan. 22, 2018, is incorporated by reference herein in its entirety.

BACKGROUND ART

An image forming apparatus is an apparatus that performs image data generation, printing, reception, transmission, and the like. Representative examples of this apparatus include a printer, a copier, a facsimile, and a multifunctional apparatus which implements a function of them in an integrated manner.

Such an image forming apparatus picks up the printing paper loaded in the loading tray to a transfer path, forms an image on the picked-up printing paper, and performs a printing operation.

DISCLOSURE OF INVENTION

Brief Description of Drawings

FIG. 1 is a block diagram illustrating a configuration of an example image forming apparatus;

FIG. 2 is a block diagram which illustrates a configuration of an example image forming apparatus;

FIG. 3 is a configuration map according to an example of the engine of FIG. 1;

FIG. 4 is a view illustrating a configuration of an example transfer device of FIG. 1;

FIGS. 5-6 are views to describe an operation of an example image forming apparatus when a fixed pickup starting time is used;

FIGS. 7-8 are views to describe an operation of an example image forming apparatus to use a flexible pickup starting time;

FIG. 9 is a flowchart to describe an example image forming method; and,

FIGS. 10 and 11 are flowcharts to describe an example transfer control operation.

MODE FOR THE INVENTION

Various examples are described in greater detail below with reference to the accompanying drawings.

In the following description, like drawing reference numerals are used for like elements, even in different drawings. The matters defined in the description, such as detailed construction and elements, are provided to assist in a comprehensive understanding of the various examples. However, it is apparent that the examples may be practiced without those specifically defined matters.

A singular expression includes a plural expression, unless otherwise specified. It is to be understood that the terms such as "comprise" or "consist of" are used herein to designate a presence of a characteristic, number, step, operation, element, component, or a combination thereof, and not to preclude a presence or a possibility of adding one or more of other characteristics, numbers, steps, operations, elements, components or a combination thereof.

The term "image forming job" as used herein may refer to various jobs related to the image. For example, an image forming job may refer to printing, scanning, or faxing. For example, an image forming job may refer to forming an image or generating, storing, transmitting, an image. A "job" may refer not only to an image forming operation but also a series of processes which are necessary for performing an image forming operation.

The term "image forming apparatus" may refer to a device that prints print data generated by a terminal device such as a computer on recording paper. Examples of such an image forming apparatus include a copying machine, a printer, a facsimile, or a multi-function printer (MFP) that combines the functions of the copier, the printer, and the facsimile through a single device. The term may refer to any device capable of performing image forming operations, such as a printer, a scanner, a fax machine, a multi-function printer (MFP), or a display apparatus.

The term "hard copy" may refer to an operation of outputting an image to a print medium such as paper, and "soft copy" may refer to an operation of outputting an image to a display device such as a TV or a monitor.

Further, the term "content" may refer to all kinds of data to be subjected to an image forming operation such as a photograph, an image, or a document file.

The "print data" may refer to data converted into a printable format in the printer. For example, if the printer supports direct printing, the file itself may be print data.

Also, the term "user" may refer to a person who performs an operation related to an image forming operation using an image forming apparatus or a device connected with an image forming apparatus by wire or wirelessly. Also, "administrator" may refer to a person who has authority to access all the functions and systems of the image forming apparatus. The "administrator" and "user" may be the same person.

FIG. 1 is a block diagram illustrating a configuration of an image forming apparatus according to an example.

Referring to FIG. 1, the image forming apparatus 100 includes an engine 110, a transfer device 120, a sensor 130, and a processor 140.

Here, the image forming apparatus 100 is an apparatus that performs generation, printing, reception, transmission, and the like of image data, and includes a printer, a copier, a facsimile, or a multifunctional apparatus that integrally implements these functions. Although the example is described as being applied to the image forming apparatus for forming an image, it may also be applied to an image reading apparatus such as a scanner.

The engine 110 performs an image forming job. For example, the engine 110 can perform an image forming job by forming an image on the image forming medium and transferring the formed image to the printing paper.

In the example, it is described that the engine 110 performs an image forming job, but when the image forming apparatus 100 is a scanner or a multi-functional device for performing a scanning work, the engine 110 may perform an image reading job. The configuration of the engine 110 will be described later with reference to FIG. 3.

The transfer device 120, which may also be referred to as a paper transfer unit, moves the loaded printing paper to the transfer path. For example, the transfer device 120 can pick up the printing paper loaded in the loading unit, which may also be referred to as a cassette, so that the printing paper is supplied to the engine 110, and transfer the picked-up printing paper to the transfer path. To this end, the transfer device 120 may include at least one motor and a plurality of rollers. An example configuration and operation of the transfer device 120 will be described later with reference to FIG. 4.

The sensor 130 may sense the printing paper at a predetermined position on the transfer path. For example, the sensor 130 may be a paper detection sensor that detects whether a printing paper is positioned at a predetermined position of the paper path. The sensor 130 may be a registration sensor. In the meantime, other sensors besides the registration sensor may be used at the time of implementation.

The processor 140 performs control for each configuration in the image forming apparatus 100. For example, when receiving the print data from the print control terminal, the processor 140 controls the operation of the engine 110 so that the received print data is printed, and controls the transfer device 120 so that printing paper is provided to the engine 110.

For example, the processor 140 can perform the image start at the set image interval and control the transfer device 120 to perform the pickup of the printing paper according to the set pickup time interval. Here, the image start interval period is a time interval between two consecutive images, and can be changed according to the performance and print type of the image forming apparatus.

The pickup time interval is a time interval during which the pickup of the printing paper is performed based on the image start time for a particular page. For example, in an image forming apparatus operating at 30 ppm, image start may be performed at two second intervals, and the pickup may be performed after 0.9 seconds after image start. In the meantime, when a plurality of paper cassettes are provided in the image forming apparatus, they may have different values depending on the paper cassettes providing the printing paper. In the above-described example, although the pickup time is described as being performed after the image start time, if the position of the paper cassette is significantly spaced apart, the pickup of the printing paper may be performed before the image start.

The processor 140 may control the engine 110 and the conveying device 120 such that the operating speed of the engine 110 and the transfer device 120 is constant even when the image start interval period and the pickup time interval are changed.

The processor 140 may then determine if a pickup time adjustment is required. For example, when the first print command is input after the predetermined event occurs, the processor 140 can determine that the pickup time adjustment is necessary. Here, the predetermined event may be the opening/closing of the paper load tray, the power-on, and the change of the paper type of the loading tray.

The processor 140 can continuously check the paper transfer time during the printing process, and can determine that the pickup time adjustment needs to be performed when a difference between the determined transfer time and the predetermined transfer time occurs, that is, when a transfer delay occurs.

For example, the predetermined transfer time may be the time taken for the transfer time from the pickup to the registration sensor. In this case, the processor 140 can check the actual transfer time by measuring the time taken until the signal that the sensor 130 senses the paper has been received since the transfer of the pickup command is transmitted to the transfer device 120. In the meantime, at the time of implementation, the transfer time can be determined based on a signal detected by a sensor other than the registration sensor, and skew time can also be used. Here, the skew time is a time difference between the arrival of the printing paper on the registration sensor and the arrival of the image.

The processor 140 can adjust the pickup time so as to advance the pickup of the printing paper when it is determined that the pickup time adjustment is necessary. For example, if a predetermined event occurs the processor 140 may adjust the pickup time for the first page. The predetermined event can be the opening/closing of the paper load tray, the power-on, or the change of the load paper type, or the like. Also, if a transfer delay is determined during the printing process, the processor 140 may adjust the pickup time (i.e., the pickup time interval) for the next page. The time adjusted here may be a predetermined time value (if it is the first page) or an integer multiple of the calculated delay time.

The processor 140 may adjust the image start interval period if it is determined that the pickup time adjustment is necessary. For example, if the print speed of the engine section is 30 ppm, the image start interval period of the engine section 110 may be 2 s. If a pickup time adjustment is needed in this case, the processor 140 may change the image start interval period over a long period by adding a predetermined time period. The added time may be a predetermined time value (if the first page) and may be a calculated delay time.

The processor 140, if determining that pickup time adjustment is necessary as described above, may control the engine 110 and the transfer device 120 so that the operation speed of the engine 110 and the transfer device 120 can be the same. That is, the operation speed of the motor which operates the engine 110 and the transfer device 120 can be the same as the case where pickup time adjustment is not necessary.

In the meantime, if the transfer delay has not occurred after the pickup time adjustment, the processor 140 can control the transfer device 120 to pick up the printing paper for the next page in accordance with the predetermined pickup time interval.

In the meantime, the processor 140 determines whether replacement or inspection of a consumable item is necessary. For example, even when a general printing paper is used, if the continuous transfer delay occurs, the processor 140 can determine that an abnormality has occurred in the transfer device, for example, aging or contamination of the rollers. If it is determined that an abnormality has occurred in the transfer device, the processor 140 controls the communication unit 150 so that an after-service (A/S) can be performed, or displays a message requesting to proceed with the inspection.

In describing FIG. 1, it has been illustrated that the transfer device 120 and the sensor 130 are separate configurations, but in implementation, the transfer device 120 may be realized as a configuration within the sensor 130.

In the description of FIG. 1, it is described that both the pickup time and the image start interval are adjusted when the transfer delay occurs. However, in the implementation, it is possible to implement the pickup time point alone, and it can also be implemented in the form of adjusting image start interval alone.

The example configurations of the image forming apparatus have been described but in time of realization, various configurations can be provided. This will be described with reference to FIG. 2.

FIG. 2 is a block diagram which illustrates an example configuration of an image forming apparatus.

The engine 110, the transfer device 120, the sensor 130, and the processor 140 perform the same function as FIG. 1, and duplicate description will be omitted. The image forming apparatus 100 according to an example of the disclosure includes the engine 110, the transfer device 120, the sensor 130, and the processor 140, a communication unit 150, an input unit 160, an operation input unit 170, and a memory 180.

The communication unit 150 is connected to a print control terminal device (not shown), and receives print data from the print control terminal device. For example, the communication unit 150 is formed to connect the image forming apparatus 100 to an external device, and is connected to the terminal device via a local area network (LAN) and the Internet network. In addition, the communication unit can be connected through universal serial bus (USB) port or wireless communication (e.g., WiFi 802.11a/b/g/n, NFC, Bluetooth) port. Here, the print control terminal device may be a general PC, a notebook, or a mobile device such as a smart phone.

The communication unit 150 receives print data from the print control terminal device. Further, when the image forming apparatus 100 has a scanner function, the communication unit 150 can transmit the generated scan data to the print control terminal device or an external server (not shown).

The communication unit 150 may receive information regarding printing paper loaded in a cassette of the image forming apparatus 100.

The display 160 displays various information provided by the image forming apparatus 100. For example, the display 160 may display an operation state of the image forming apparatus 100, or may display a user interface window for selecting functions and options that the user can select. The display 160 may be a monitor such as an LCD, a CRT, or the like, and may be implemented as a touch screen capable of simultaneously performing functions of an operation input unit 170 to be described later.

The display 160 displays an operation state of the image forming apparatus 100. The display 160 may display information requesting input of information about the loaded printing paper when opening and closing of the loading tray (or cassette) for loading the paper is detected.

The operation input unit 170 includes a plurality of function keys that the user can set or select various functions supported by the image forming apparatus 100. The operation input unit 170 may be implemented as a device such as a mouse, a keyboard, or the like, and may be implemented as a touch screen capable of simultaneously performing the functions of the display 160 described above. Through this, the user can input various driving commands to the image forming apparatus 100.

When the image forming apparatus 100 has a plurality of paper loading trays, the operation input unit 170 can select a paper loading tray to be used for a printing operation. For example, the operation input unit 170 may receive various information related to the printing paper to be performed in the printing operation. Here, various information related to the printing paper may be paper size, coating condition, thickness information, and the like.

The memory 180 may store print data. For example, the memory 180 may store the print data received from the communication unit 150 described above. The memory 180 may be implemented as a storage medium in the image forming apparatus 100, and may be implemented also as an external storage medium, a removable disk including a USB memory, and a web server via a network, or the like.

The memory 180 may store a lookup table for controlling the transfer device 120.

Here, the lookup table may be information on the printing environment and the pickup time point for each printing paper, or information on the pickup time point for each delay time.

The memory 180 may store information on the calculated delay time, on the currently set image start timing, and pickup time interval.

As described above, the image forming apparatus 100 according to the example performs adjustment to advance the pickup time when a transfer delay is anticipated or a transfer delay occurs, so that the printing paper can be reached within a predetermined time than the image. Thus, the image forming apparatus can prevent the skew and jam occurrence of the printing paper.

FIG. 3 is a configuration map according to an example of the engine of FIG. 1.

Referring to FIG. 3, the engine 110 includes a photosensitive drum 111, a charger 112, a light exposure device 113, a developing device 114, a transfer device 115, and a fuser 118. In FIG. 1, it is described that the engine 110 and the transfer device 120 are configured to have different configurations. However, the transfer device 120 may be a configuration within the engine 110.

An electrostatic latent image is formed on the photosensitive drum 111. For example, an image can be formed on the photosensitive drum 111 by the action of the charger 112 and the light exposure device 113, which will be described later. The photosensitive drum 111 may be referred to as an image forming medium, a photosensitive drum, a photosensitive belt or the like depending on its form.

In the following description, the structure of the engine 110 corresponding to one color will be described for the sake of simplicity, but in actuality, the engine 110 may include a plurality of photosensitive drums 111, a plurality of chargers 112, a plurality of light exposure devices 113, a plurality of developing devices 114, and an intermediate transfer belt.

The charger 112 charges the surface of the photosensitive drum 111 to a uniform potential. The charger 112 may be implemented in the form of a corona charger, a charging roller, a charging brush, or the like.

The light exposure device 113 changes the surface potential of the photosensitive drum 111 according to image information to be printed, thereby forming an electrostatic latent image on the surface of the photosensitive drum 111. As an example, the light exposure device 113 can form an electrostatic latent image by irradiating the photosensitive drum 111 with light modulated in accordance with image information to be printed. The light exposure device 113 of this type may be referred to as a light scanning device or the like, and an LED may be used as a light source.

The developing device 114 accommodates a developer therein, and supplies a developer (for example, toner) to the electrostatic latent image to develop the electrostatic latent image into a visible image. The developing device 114 may include a developing roller 117 that supplies the developer to the electrostatic latent image. For example, the developer may be supplied from the developing roller 117 to the electrostatic latent image formed on the photosensitive drum 111 by a developing electric field formed between the developing roller 117 and the photosensitive drum 111.

A visible image formed on the photosensitive drum 111 is transferred to the recording medium P by the transfer device 115 or an intermediate transfer belt (not shown). The transfer device 115 can transfer a visible image to the recording medium by, for example, an electrostatic transfer method. The visible image is attached to the recording medium P by electrostatic attraction.

The fuser 118 fixes a visible image on the recording medium P by applying heat and/or pressure to a visible image on the recording medium P. The printing operation is completed by this series of processes.

The above-described developer is used every time the image forming operation proceeds, and becomes exhausted when it is used for a predetermined time or more. In this case, a unit for storing the developer (for example, the developer 114 described above) must be newly replaced. In this way, during the use of the image forming apparatus, the replaceable parts or components that can be replaced are called a consumable unit or replaceable unit. A memory (or CRUM chip) may be attached to this consumable unit for proper management of the consumable unit.

Meanwhile, the transfer device 120 can perform the operation of rotating the respective components of the engine 110 described above. In the meantime, at the time of implementation, one transfer device 120 can simultaneously rotate a plurality of configurations of the engine 110, and a plurality of motors can be combined to rotate the plurality of configurations.

Below, the configurations of the transfer device 120 will be described with reference to FIG. 4.

FIG. 4 is a view illustrating a configuration of a transfer device of FIG. 1.

Referring to FIG. 4, the transfer device 120 moves the printing paper stacked on the loading tray to a predetermined paper transfer path. To this end, the transfer device 120 may include a plurality of motors 120-1, 120-2 and 120-3 and a structures R1, R2, R4, and R6 which move by the plurality of motors 120-1, 120-2 and 120-3 and auxiliary structures R3, R5 and R7 which rotate by a movement of the structures R2, R4 and R6.

The plurality of motors 120-1, 120-2, and 120-3 provide power for starting the structure. For example, the first motor 120-1 drives the plurality of rollers R1 and R2 to feed the document stacked on the loading tray into the paper path. That is, the first motor 120-1 can pick up the original placed on the loading tray by the transfer path. At this time, the first motor 120-1 may perform a pickup operation based on a pickup signal provided from the processor 140. Here, the pickup signal may be provided to the first motor 120-1 after the image has been started and after a predetermined pickup time interval.

In the illustrated example, a pickup signal is provided directly to the motor. However, it is also possible to provide a clutch to the plurality of rollers R1 and R2 and to provide a pickup signal to the clutch for operating the pickup operation.

The second motor 120-2 drives the plurality of rollers R4 and R6 to move the printing paper discharged from the loading tray to the copier and the fuser.

The third motor 120-3 raises the printing paper in the loading tray to the upper end to start an apparatus for bringing the printing paper into contact with the roller R1. At this time, the sensor S10 senses whether the third motor 120-3 performs normal operation.

In order to check whether the paper is normally fed during the paper transfer process, paper detecting sensors 130 and 131 (S4 and S3) are disposed on the paper transfer path 10. The processor 140 can determine whether the printing paper is normally transferred according to a signal output from the paper sensor 130 or 131.

Here, the paper detecting sensor 131 may be a paper sensing sensor for sensing whether the pickup is normally performed, and the sensor 130 may be a registration sensor for providing the printing paper to the engine 110 at an accurate timing. Meanwhile, in the implementation, the paper detection sensor 131 may include a plurality of sensors S1, S2, and S3 as shown in FIG. 4.

In the illustrated example, one loading tray is provided. However, the image forming apparatus may be provided with a plurality of loading trays. The transfer device 120 may provide the printing paper of each loading tray to the engine 110.

Although two sensors are illustrated in FIG. 4, sensors other than the sensors described above may be additionally provided on the transfer path, and the transfer delay may be detected using the additional sensor. In addition, the image forming apparatus 100 may further include a sensor for detecting opening/closing of the loading tray as well as the transfer path.

In the meantime, as described above, since the printing paper is picked up by the roller in the loading tray and provided to the engine 110, if there are many perforated lines in the printing paper, the coefficient of friction with other sheets increases, causing delay in transfer. For example, transfer delays can occur due to wear or contamination of the rollers. If a transfer delay occurs, a leading edge failure occurs or a jam occurs.

With reference to the above operations, FIGS. 5 and 6 are described below.

FIGS. 5-6 are views to describe an operation of an image forming apparatus when a fixed pickup start timing is used.

The image start time is determined according to the engine speed of the image forming apparatus. For example, an image forming apparatus having a printing speed of 30 PPM can start the image forming operation at intervals of two seconds. This interval is referred to as an image start period (ΔIT). In addition, the pickup time point may be started after a predetermined time interval (ΔPT) after the start of the image in conjunction with this image start time period. For example, the predetermined time interval may be 0.9 seconds.

The predetermined time interval is a time set so that the picked up printing paper reaches the registration sensor about 0.2 seconds (ΔST) earlier than the image. Here, the skew time (ΔST) is a time interval at which the printing paper reaches the registration sensor and a time interval at which the image reaches the registration sensor. When the time difference is 0.1 second or more, normal printing is possible. If the time difference is between 0.1 second and 0.05 second, the printing paper is turned on at the time of transferring, and when it is less than 0.05 seconds, paper jam occurs.

Referring to FIG. 5, starting of an image with respect to Image 1(*t*), Image 2(*t*), and Image 3(*t*) can be confirmed with a predetermined time interval (for example, two seconds).

It can be confirmed that, after image start of each page, paper pickup is performed after a predetermined time interval (for example, 0.9 seconds).

The printing paper for each page reaches about 0.2 seconds earlier than the image arrival time to the registration sensor, so that the normal printing operation can be performed.

An operation in the case where a printing paper with high friction coefficient is loaded will be described with reference to FIG. 6.

The printing paper having a large number of perforated lines increases the coefficient of friction with other printing paper, and it takes longer time to be conveyed to the registration sensor 130 than the ordinary printing paper. That is, a transfer delay occurs. For example, in FIG. 6, it is assumed that the first page is delayed by 0.1 seconds compared to a general case, the second page is delayed by 0.15 seconds compared to a general case, and the third page is delayed by 0.3 seconds compared to a general case.

The first page was delayed by 0.05 seconds, but ΔST was 0.15 seconds and thus, normal printing job is available.

The second page was delayed by 0.15 seconds. As ΔST was 0.05 seconds and printing job can be performed but a skew problem may occur. That is, the front end margin defect occurs.

The third page is delayed by 0.3 seconds, and the image of ΔST reaches −0.1 seconds, so that the image reaches the registration sensor first. If the image first arrives at the registration sensor, the processor 140 generates a jam.

For example, when the printing paper having a high coefficient of friction is not used one time, the above-described skew problem and jam occurrence continue to be a problem. Also, even when the rollers involved in the transfer are aged or contaminated, the skew problem and jam occurrence as described above may continue to be a problem.

Therefore, in the disclosure, it is determined whether a transfer delay has occurred or a transfer delay is likely to occur. That is, it is determined whether or not the transfer control adjustment needs to be performed. As described above, the transfer delay may occur due to a kind of printing paper being loaded, roller aging, or contamination rather than a general printing paper.

Therefore, it is possible to measure the movement time of the printing paper continuously and determine that the transfer control adjustment is necessary when the measured movement time is longer than the predetermined movement time.

In the meantime, if it is determined that the transfer control adjustment is necessary by measuring the movement time, the transfer control adjustment for the first page cannot be performed. However, if the user performs the initial print job after loading the printing paper with high frictional force, the transfer delay may occur also for the first page, and skew or jam may occur.

Therefore, when the printing paper changes as a paper loading tray is opened and closed, when a user changes (setting as a type of printing paper) a type of printing paper, and when power is off and then on, it can be determined that it is necessary to perform a transfer control adjustment.

In the meantime, if it is determined that the transfer control adjustment is necessary, the processor 140 can adjust the pickup time so as to advance the pickup of the printing paper. Also, the image start interval period can be adjusted into a longer period.

$$\Delta PT1=\Delta PT-\alpha$$

$$\Delta IT1=\Delta IT+\beta$$

Here, ΔPT1 is the adjusted pickup time interval, ΔPT is the predetermined (or default) pickup time interval, ΔIT1 is the adjusted image start interval, and ΔIT is the predetermined (or default) image start interval. Further, a is a pickup adjustment time, a predetermined constant value may be used for the first page, and may be an integral multiple of the delay time when the delay time is calculated. In addition, β is an image adjustment time, a predetermined constant value may be used for the first page, and a delay time may be used when the delay time is calculated.

For example, if the user first performs the print job after changing the paper in the loading tray, the processor 140 sets the pickup time interval for the first page and the image start time for the next page as follows.

$$\Delta PT1=\Delta PT-\alpha(\alpha=0.4\text{ seconds})=0.9\text{ seconds}-0.4\text{ seconds}=0.5\text{ seconds}$$

$$\Delta IT1=\Delta IT+\beta(\beta=0.2\text{ seconds})=2\text{ seconds}+0.2\text{ seconds}=2.2\text{ seconds}$$

After this operation, the transfer time is measured. For example, Sheet1 (*t*) starts after ΔPT1 from the start of Image1 (*t*). At this time, the normal arrival time from the first printing paper to the registration sensor should be ΔST1=0.6 seconds. However, when a delay of about 0.05 seconds occurs on the first printing paper, ΔST1=0.55 seconds.

If it is determined that a 0.05 seconds delay has occurred for the first page, the pickup time interval for the second page and the image start time for the third page may be adjusted as follows.

$$\Delta IT2=\Delta IT+\beta^{`}=2\text{ seconds}+0.05\text{ seconds}=2.05\text{ seconds}\quad \Delta PT2=\Delta PT-\alpha^{`}=0.9\text{ seconds}-0.05\text{ seconds}\times 2=0.8\text{ seconds}$$

If it is confirmed that a 0.15 seconds delay has occurred for the second page, the pickup time interval for the third page and the image start time for the fourth page can be adjusted as follows.

$$\Delta IT3=\Delta IT+\beta^{``}=2\text{ seconds}+0.15\text{ seconds}=2.15\text{ seconds}$$

$$\Delta PT3=\Delta PT-\alpha^{``}=0.9\text{ seconds}-0.15\text{ seconds}\times 2=0.6\text{ seconds}$$

If it is confirmed that a 0.3 seconds delay has occurred with respect to the third page, the pickup time interval for the fourth page and the image start time for the fifth page (image start interval for the fourth page) can be adjusted as follows.

$$\Delta IT4=\Delta IT+\beta^{```}=2\text{ seconds}+0.3\text{ seconds}=2.3\text{ seconds}$$

$$\Delta PT4=\Delta PT-\alpha^{```}=0.9\text{ seconds}-0.3\text{ seconds}\times 2=0.3\text{ seconds}$$

In the meantime, if there is no delay for the fourth page, the last value can be maintained as follows. For example, even if the delay does not occur with respect to the fourth page, the delay may occur again in the fifth page. In this case, jamming or skew may occur when returning to the initial value.

$$\Delta IT5=\Delta IT+\beta^{```}=2\text{ seconds}+0.3\text{ seconds}=2.3\text{ seconds}$$

$$\Delta PT5=\Delta PT-\alpha^{```}=0.9\text{ seconds}-0.3\text{ seconds}\times 2=0.3\text{ seconds}$$

Therefore, the image forming apparatus of the disclosure can continuously detect and store the arrival time of the registration sensor in the memory, and adjust the pickup start time and the image start interval for the next page based on the maximum delay time.

This adjustment value can be maintained before change of the paper of the cassette.

Hereinbelow, the operation of the case in which the pickup timing has been adjusted in advance but transfer delay does not occur is described with reference to FIG. 8.

Referring to FIG. 8, since the first page cannot calculate the transfer delay, it is possible to adjust the pickup time interval and the image start time for the next page by using a constant value as in FIG. 7.

$$\Delta PT1=\Delta PT-\alpha(\alpha=0.4 \text{ seconds})=0.9 \text{ seconds}-0.4 \text{ seconds}=0.5 \text{ seconds}$$

$$\Delta IT1=\Delta IT+\beta(\beta=0.2 \text{ seconds})=2 \text{ seconds}+0.2 \text{ seconds}=2.2 \text{ seconds}$$

Paper pickup is performed using the adjusted pickup time interval. Thereafter, it is possible to determine whether a transfer delay has occurred by using the detection time of the registration sensor after the pickup. As a result of the determination, if there is no transfer delay for the first page, a predetermined pickup time interval and a predetermined image start interval may be used for the second page as follows.

$$\Delta IT2=\Delta IT=2 \text{ seconds}$$

$$\Delta PT2=\Delta PT=0.9 \text{ seconds}$$

In the following process, the delay time for each page is measured. If the measured delay time does not exceed the threshold value, the same default value can be used. Here, the threshold value may be set differently depending on the transfer force of the transfer device and the available paper type.

In describing FIGS. 7 and 8, it is described that both the pickup time interval and the image start interval are adjusted. However, in implementation, the pickup time interval can also be adjusted alone and the image start interval not adjusted.

In the description of FIG. 8, it has been described that the default pickup time interval is directly used for the second page if there is no transfer delay for the first page. However, in the implementation, the pickup time can also be adjusted by a constant value. In addition, the pickup time to be adjusted may be reduced in a sequential manner.

FIG. 9 is a flowchart to describe an image forming method.

Referring to FIG. 9, an image is formed on the image forming medium (S910). For example, a printing job can be performed in a predetermined image start interval.

Then, the loaded printing paper is picked up and moved to the transfer path (S920). For example, it is possible to pick up the loaded printing paper after the predetermined pickup time interval since the start of the image. In the meantime, when the first printing operation is performed after the occurrence of the events such as opening/closing of the paper loading tray, power on, paper type change, etc., the loaded paper can be picked up faster than the predetermined pickup time interval.

If a printing paper is detected at a predetermined position on the transfer path, it is determined whether a transfer delay has occurred (S930). For example, the transfer time to a predetermined position after the pickup is measured using a timer, and the measured time is compared with a predetermined time to determine whether a transport delay has occurred. In the meantime, at the time of implementation, it is possible to judge whether a transfer delay has occurred by comparing the time difference (ΔST) between the image and the printing paper in the registration sensor with the predetermined time difference.

For example, when ΔST in an image forming apparatus is 0.2 seconds, it can be determined that transfer delay occurs if ΔST for the first page is shorter than 0.2 seconds.

If a transfer delay occurs, the pickup time is adjusted so that the pickup of the printing paper for the next page is advanced (S940). For example, if a transfer delay occurs, it can be adjusted to reduce the predetermined pickup time interval. For example, the pickup time interval can be reduced by an integral multiple of the calculated delay time.

In addition, if a transfer delay occurs, it is also possible to adjust the interval of a predetermined image start interval. For example, the image start interval can be increased by the calculated delay time.

In the meantime, if the pickup time is reduced for the first page but there is no transfer delay, the adjusted pickup time interval can be set to the original predetermined pickup time interval.

Therefore, in the image forming method of the disclosure, adjustment is performed to advance the pickup time when a transfer delay is anticipated or a transfer delay occurs, so that the printing paper can reach the image within a predetermined time period. Thus, this image forming method can prevent skew and jam occurrence of the printing paper. The image forming method as shown in FIG. 9 can be executed on an image forming apparatus having the configuration of FIG. 1 or FIG. 2, and also on an image forming apparatus having other configurations.

The image forming method can be implemented as a program and provided to an image forming apparatus. For example, a program including the image forming method can be stored in a non-transitory computer readable medium and provided.

The non-transitory computer-recordable medium is not a medium configured to temporarily store data such as a register, a cache, or a memory but an apparatus-readable medium configured to semi-permanently store data. For example, the above-described various applications or programs may be stored in the non-transitory apparatus-readable medium such as a compact disc (CD), a digital versatile disc (DVD), a hard disc, a Blu-ray disc, a universal serial bus (USB), a memory card, or a read only memory (ROM), and provided therein.

FIGS. 10 and 11 are flowcharts to describe a transfer control operation. FIG. 10 is a flowchart to describe a transfer control operation of a first page, and FIG. 11 is a flowchart to describe a transfer control operation of a second page.

First, ΔPT (1) indicates the pickup start time for the first page, and ΔIT (1) indicates the image start time (or the interval between the first image and the second image) for the second page. In addition, α(1) and β(1) are constant values for the first page. This value can be stored in memory.

Referring to FIG. 10, when the image start for the first page is done, the values of α(1) and β(1) for the first page are read from the memory (S1015) and the pickup start time can be adjusted based on the read value (S1020). If necessary, the image start time can also be adjusted (S1010).

Whether the adjusted pickup start time is reached is to be continuously checked (S1025) and if the adjusted pickup start time has been reached (S1025-Y), the pickup of the first page is performed (S1030) and the timer is operated (S1035).

Here, the timer (sensor) is a timer for measuring the transfer time. When the front end of the printing paper reaches the registration sensor with a timer that operates after the pickup starts, the timer stops. In the transferring process, time of the timer continuously increases (S1045). In implementation, it is possible to use a feed sensor instead of a registration sensor depending on the position of the tray.

When the registration sensor detects the first printing paper (S1040-Y), the timer is stopped and the delay time is calculated (S1055). Here, Rth is a normal signal from the start of pickup to the registration sensor, and may be stored in the memory.

If a delay has occurred (S1060-Y), adjustment to advance the pickup time interval for the next page and adjustment to increase the image start interval can be performed (S1070, S1075).

If the transfer delay does not occur (S1060-N), a distance between the adjusted pickup start interval and the image start interval can be restored to a default value (S1065).

Referring to FIG. 11, if the adjusted image start time is reached (S1105), the image start for the second page is performed (S1110).

It is determined whether the pickup start time set in the previous operation is reached (S1125). For example, if there is no transfer delay for the first page, it can be confirmed whether the default pickup start time has been reached (S1125). On the contrary, if a transfer delay occurs, it can be confirmed whether or not an adjusted pickup start time point reflecting the delay time is reflected (S1120, S1125).

When the pickup start time for the second page is reached (S1125-Y), the pickup of the second page is performed (S1130) and the timer is operated (S1135). At this time, time of the timer continuously increases (S1145).

If the second printing paper is detected (51140-Y) in the registration sensor, timer is stopped (S1150), and the delay time can be calculated (S1155).

If the delay has occurred (S1160-Y), if the delay for the second page is greater than the delay for the first page (S1165-Y), adjustment is made to advance the pickup time interval based on the delay time for the second page and increase the image start interval (S1170, S1180). Conversely, if the delay for the first page is larger (S1165-N), the adjusted pickup time interval and image start interval are maintained (S1175).

If there is no delay for the second printing paper (S1160-*n*), the set value on the first page is maintained (S1185, S1175, and S1190). For example, if no delay has occurred for the first page (S1185-N), the pickup time interval and the image start interval set as the default values are maintained (S1190).

In the meantime, if there is a delay with respect to the first printing paper (S1185-Y), the pickup time interval and the image start interval in which the delay time of the first page is considered remain unchanged (S1175, S1180).

Accordingly, the transfer control operation of the disclosure can make the adjustment to advance the pickup time when the transfer delay is anticipated or the transfer delay occurs, and allows the printing paper to reach the image within a predetermined time period. Accordingly, the transfer control operation can prevent the skew of the printing paper and the occurrence of jamming. As in FIGS. 10 and 11, the transfer control operation can be executed on the image forming apparatus having the configuration of FIG. 1 or FIG. 2, and also on the image forming apparatus having other configurations.

Meanwhile, the above-described transfer control operation can be implemented by a program and provided to an image forming apparatus. In particular, a program including an image forming method may be stored in a non-transitory computer readable medium and provided.

The foregoing examples are merely examples and are not to be construed as limiting the disclosure. The examples may be readily applied to other types of device or apparatus. Also, the description of the examples is intended to be illustrative, and not to limit the scope of the disclosure, and many alternatives, modifications, and variations may be made to the examples.

The invention claimed is:

1. An image forming apparatus, comprising:

an engine to form an image on an image forming medium;

a transfer device to pick up a printing medium and transfer the printing medium to a transfer path to supply the printing medium to the engine;

a sensor to sense the printing medium at a predetermined position on the transfer path; and a processor to control the engine and the transfer device to maintain a constant operating speed, to determine whether a transfer delay of the printing medium occurs by continuously measuring a movement time of the printing medium along the transfer path and comparing the measured movement time to a predetermined movement time, to adjust a pickup timing to advance a pickup by the transfer device of a next printing medium corresponding to a next page when the processor determines the transfer delay occurs, and to transmit an indication of an abnormality when the transfer delay occurs.

2. The image forming apparatus of claim 1, wherein the processor is to:

control the engine to perform image forming for each printing medium at a predetermined image start time interval, control the transfer device to pick up the printing medium at a predetermined pickup time interval beginning from a start of the predetermined image start time interval, and adjust the predetermined pickup time interval when the transfer delay occurs.

3. The image forming apparatus of claim 2, wherein the processor is to control the engine when the transfer delay occurs, so that image forming is performed with an interval longer than the predetermined image start time interval.

4. The image forming apparatus of claim 3, wherein the processor is to calculate a delay time of the printing medium, delay an image start timing of the next printing medium by the delay time, and advance a pickup timing of the next printing medium by an integer multiple of the delay time.

5. The image forming apparatus of claim 1, wherein the processor is to control the transfer device and the engine so that an operating speed of the transfer device and the engine are the same during printing of the printing medium and printing of the next printing medium.

6. The image forming apparatus of claim 1, wherein the processor, is to control the transfer device so that the printing medium is picked up faster than a predetermined pickup time interval when an initial print command is input after a predetermined event occurs.

7. The image forming apparatus of claim 6, wherein the predetermined event is one of opening and closing of the printing medium loading tray, turning on power, and changing a type of the printing medium in the tray.

8. The image forming apparatus of claim 6, wherein the processor is to determine whether the transfer delay occurs when the printing medium is sensed, and when the transfer delay does not occur, the processor is to control the transfer device to pick up the next printing medium according to the predetermined pickup time interval.

9. The image forming apparatus of claim 1, wherein the processor to control the engine and the transfer device so that an operation speed of the engine is the same as an operation speed of the transfer device.

10. The image forming apparatus of claim 1, wherein the processor to determine whether to transmit an indication to replace or inspect a consumable item of the image forming apparatus.

11. The image forming apparatus of claim 1, wherein the processor to determine whether the abnormality is in the transfer device.

12. An image forming method of an image forming apparatus, the method comprising:

forming an image on an image forming medium;

picking up a printing medium and transferring the printing medium to a transfer path so that the image formed on the image forming medium can be transferred to the printing medium;

controlling an engine and a transfer device to maintain a constant operating speed;

determining whether a transfer delay of the printing medium occurs by continuously measuring a movement time of the printing medium along the transfer path and comparing the measured movement time to a predetermined movement time;

adjusting a pickup timing to advance a pickup of a next printing medium corresponding to a next page when the determining determines the transfer delay occurs; and transmitting an indication of an abnormality when the transfer delay occurs.

13. The method of claim 12, wherein the forming the image comprises performing image forming for each printing medium at a predetermined image start time interval, the picking up comprises picking up the printing medium at a predetermined pickup time interval beginning from a start of the predetermined image start time interval, and the adjusting comprises adjusting the predetermined pickup time interval.

14. The method of claim 13, wherein the forming the image comprises performing image forming with an interval longer than the pre-determined image start time interval when the transfer delay occurs.

15. The method of claim 14, further comprising:

calculating a delay time of the printing medium, wherein the adjusting comprises delaying an image start timing of the next printing medium by the delay time, and advancing a pickup timing of the next printing medium by an integer multiple of the delay time.

16. The method of claim 13, wherein the picking up comprises, when an initial print command is input after a predetermined event occurs, picking up the medium faster than the predetermined pickup time interval.

17. The method of claim 16, wherein the predetermined event is one of opening and closing of the printing medium loading tray, turning on power, and changing a type of the printing medium in the tray.

18. The method of claim 16, wherein the adjusting comprises determining whether the transfer delay occurs when the printing medium is sensed, and when the transfer delay does not occur, adjusting the pickup timing so a start of the pickup of the next printing medium is performed according to the predetermined pickup time interval.

19. The image forming method of claim 12, further comprising:

controlling the engine and the transfer device so that an operation speed of the engine is the same as an operation speed of the transfer device.

20. The image forming method of claim 12, further comprising:

determining whether to transmit an indication to replace or inspect a consumable item of the image forming apparatus.

* * * * *